US005243831A

United States Patent [19]

Major et al.

[11] Patent Number: 5,243,831

[45] Date of Patent: Sep. 14, 1993

[54] APPARATUS FOR PURIFICATION AND RECOVERY OF REFRIGERANT

[76] Inventors: Thomas O. Major, 4105 Grey, Denver, Colo. 80212; Jack E. Major, Jr., 1590 Harlan, Lakewood, Colo. 80214

[21] Appl. No.: 700,792

[22] Filed: May 15, 1991

Related U.S. Application Data

[63] Continuation-in-part of Ser. No. 464,307, Jan. 12, 1990, Pat. No. 5,078,756.

[51] Int. Cl.[5] ..... F25B 45/00

[52] U.S. Cl. ..... 62/292; 95/19

[58] Field of Search ..... 62/292, 77, 149, 474, 62/195; 55/21, 210–218, 274, 383, 267, 269

[56] References Cited

U.S. PATENT DOCUMENTS

| | | | |
|---|---|---|---|
| 3,602,002 | 8/1971 | Bailey et al. | 62/53 |
| 4,530,215 | 7/1985 | Kramer | 62/84 |
| 4,766,733 | 8/1988 | Scuderi | 62/77 |
| 4,805,416 | 2/1989 | Manz et al. | 62/292 |
| 4,856,289 | 8/1989 | Lofland | 62/149 |
| 4,903,499 | 2/1990 | Merritt | 62/292 |
| 5,078,756 | 1/1992 | Major et al. | 55/21 |

*Primary Examiner*—Albert J. Makay
*Assistant Examiner*—William C. Doerrler
*Attorney, Agent, or Firm*—J. Preston Oxenham

[57] ABSTRACT

A refrigerant purification and recovery device which directly reitroduces the refrigerant to the refrigeration unit or to a storage container. The device is separable into two parts with one part containing a receiver-separator vessel and the other part containing a compressor and a condenser.

40 Claims, 4 Drawing Sheets

APPARATUS FOR PURIFICATION AND RECOVERY OF REFRIGERANT

CROSS REFERENCE TO OTHER APPLICATIONS

This patent application is a continuation-in-part of U.S. patent application Ser. No. 07/464,307, filed Jan. 12, 1990, now issued as U.S. Pat. No. 5,078,756, Jan. 7, 1992.

BACKGROUND OF THE INVENTION

1. Field of the Invention

The present invention relates to the recovery of refrigerant from refrigerant charged refrigerating systems and the purification of used refrigerant taken from such systems. More particularly, the present invention relates to the recovery of refrigerant from air conditioning systems prior to their repair or replacement, which systems may be in environments of disparate ambient temperatures, or may be difficult to access.

2. Description of the Prior Art

Traditionally, when refrigerant charged refrigeration systems were repaired, the refrigerant charge was simply loosed to the atmosphere as necessary to accomplish the repairs. In recent times, it has become increasingly desirable to capture and reuse the refrigerant charge in these units for two reasons; refrigerant pollution of the atmosphere is perceived as environmentally destructive and the cost of refrigerant materials has increased making the disposal and replacement of the refrigerant charge increasingly more expensive.

Refrigerant recovery devices of the prior art have compressed and cooled refrigerant from charged systems to a liquid state for storage and reintroduction to the same system after repair has been accomplished or for use in other systems. Many of these prior art recovery systems have employed filtration of the refrigerant during the removal-compression-cooling process to remove contaminants from the used refrigerant. However, devices of the prior art have not provided for the systematic removal of "noncompressible" gas contaminants, i.e. gasses much less compressible than the refrigerant, such as air, from the used refrigerant during the recovery process.

Also, under certain conditions of sufficiently high refrigerant pressure and cool ambient temperatures, some of the prior art systems are susceptible to entry of liquid refrigerant into the suction side of the recovery system compressor which may cause damage to the compressor and power components of the recovery system.

Additionally, many of the prior art recovery systems have been massive, ponderous, and unwieldy making them difficult to transport to and position near refrigerant charged refrigeration systems. Such heavy prior art systems made it inconvenient if not impossible to recover and recycle the refrigerant from many charged systems.

Further, many of the prior art systems may operate satisfactorily only in a limited range of ambient temperature and cannot effectively remove energy from the compressed refrigerant to assure its complete liquification prior to its injection into a storage container when ambient temperatures are very high. Other of the prior art recovery devices may achieve acceptable performance during recovery operations over a wide range of ambient temperatures, but at a concomitant increase in recovery system production cost that makes them economically impractical for purchase by operators providing repair services in any but the most extreme environments.

Many units of the prior art have been of such high cost as to make capture, purification and reintroduction of the refrigerant charge to refrigeration units under repair of questionable economic justification, even in a political climate of increasing environmental concern.

SUMMARY OF THE INVENTION

Accordingly, it is an object of the present invention to provide a convenient, economic, and effective refrigerant recovery and purification system for recovering and purifying refrigerant charges of refrigeration systems for reintroduction to the same refrigeration system or use in another refrigeration system.

It is an object of the present invention to provide a refrigerant recovery and purification system which is lighter weight, at least in its component parts, less bulky, and therefore, easier to transport and maneuver into position.

It is also an object of the present invention to provide a light weight refrigerant purification system which will remove "noncompressible" gas contaminants from recovered refrigerant in a systematic and economic manner.

It is a further object of the present invention to utilize a method of refrigerant purification which may be adapted to a completely automated system or accomplished with operator observation and interaction with the recovery-purification apparatus.

It is also an object of the present invention to provide a light weight, convenient, apparatus for refrigerant recovery and purification which will not be subject to compressor damage due to entry of liquid phase refrigerant into the suction side of the compressor of the recovery apparatus.

It is an object of the present invention to provide a light weight, convenient refrigerant recovery and purification system which is also adaptable to effectively reduce recovered refrigerant to a liquid phase for storage under a wide range of ambient temperatures.

It is yet a further object of the present invention to provide a conveniently transported refrigerant recovery system which may be manufactured at a low cost, yet may be adapted as necessary to perform effectively in very high ambient temperature conditions.

To achieve the foregoing and other objects and in accordance with the purpose of the present invention, as embodied and broadly described herein, the apparatus of this invention may compromise a refrigerant purification and recovery apparatus including a plurality of relatively light weight units containing a compressor, a condenser and a receiver-separator vessel distributed among the units. A first conduit is provided with a valve and connecting means at a first end for connecting the purification-recovery apparatus in fluid communication with the fluid circuit of a refrigeration unit from which refrigerant is to be removed and purified. A second end of the first conduit is connected to the suction side of the compressor. A high pressure side of the compressor is connected in fluid communication with an upstream end of the condenser by a second conduit. A third conduit has an upstream end connected to a downstream end of the condenser and a downstream end connected to the receiver-separator vessel at a location between a top portion and a bottom portion of the vessel. A gas vent valve is provided in an upper most portion of the receiver-separator vessel for venting gas from the receiver-separator vessel to the atmosphere, and a drain valve is provided in a lower most portion of the receiver-separator vessel for draining fluid from the receiver-separator vessel into a temporary refrigerant storage container placed in fluid communication with the drain valve. In a preferred embodiment of the purification-recovery system, filters are placed in the first and second conduits to mechanically and chemically remove water, oil and other contaminants from the refrigerant drawn from the refrigeration system.

During operation of the refrigerant purification and recovery apparatus comprising the present invention, refrigerant is drawn from the refrigeration system through the first conduit and the first filter to the suction side of the compressor. The refrigerant is compressed and flows at high pressure through the condenser where heat of compression is removed by heat exchange with surrounding fluid before the refrigerant passes through the third conduit and its filter and into the receiver-separator vessel. Pressure in the receiver-separator vessel is maintained sufficiently high that refrigerant in liquid phase will accumulate in the bottom of the receiver-separator vessel where it may be periodically drawn off to a storage container. Refrigerant in gas phase will fill the remaining volume of the receiver-separator vessel above the liquified refrigerant together with "noncompressible" contaminants, such as air, helium, nitrogen etc., which will remain in gas phase at the pressure and temperature within the receiver-separator vessel. These gasses are of lower molecular weight than the refrigerant and will accumulate at the upper most extreme of the receiver-separator vessel above the gaseous refrigerant where they may be bled off from time to time through the vent valve at the top of the receiver-separator vessel.

The purification and recovery apparatus also includes a pressure sensor for sensing pressure in the upper portion of the receiver-separator vessel and generating a signal indicative of that pressure and a liquid sensor for sensing the presence of a liquid at a point in the receiver-separator vessel below the connection point of the third conduit to the vessel, and generating a signal indicative of the presence of a liquid. A control-signal device is provided to receive the pressure indicative signal and liquid presence indicative signal and to prompt a user of the recovery-purification apparatus, by use of colored lights, LCD displays or other display devices, to open the vent and drain valves in an appropriate manner. When the pressure in the receiver-separator vessel rises above a predetermined pressure and liquid is sensed at the sensor point within the vessel, the control-signal device displays a message or other signal to prompt the operator to open the drain valve for a limited duration to drain liquid from the receiver-separator vessel to the storage container. When the pressure in the vessel raises above a predetermined pressure and no liquid is sensed at the sensor point within the vessel wall, the operator is prompted to open the vent valve at the top of the vessel for a limited time to vent off "noncondensible" contaminants from the vessel.

In purification and recovery apparatus comprising a preferred embodiment of the present invention, the compressor, condenser, and receiver-separator vessel are distributed two light weight units. The receiver-separator vessel, as well as the valve and connecting means of the first conduit for connecting to the refrigeration unit from which refrigerant is to be removed are housed in a first unit. The compressor and condenser are housed in a second unit. The first conduit, second conduit, and third conduit each include a section comprised of flexible hose releasably connected between valves in each of the respective units.

A refrigerant purification and recovery device comprising an alternative embodiment of the present invention utilizes valve control means, for example, solenoid valve controls, to drain fluid and vent gas from the vessel in response to signals from the control-signal device.

The third conduit of a refrigerant recovery and purification apparatus comprising a preferred embodiment of the present invention includes an auxiliary valve for blocking flow through the conduit at a point between the third conduit upstream end and the third conduit downstream end when the valve is in a closed condition. A first connector with a Schrader-type valve is provided at a point between the auxiliary valve and the third conduit upstream end and a second connector with a Schrader-type valve is provided on the third conduit at a point between the auxiliary valve and the third conduit downstream end. An auxiliary condenser unit, with an upstream end and a downstream end adapted to connect with the first and second connector, respectively, may be connected to the first connector at the upstream condenser end and connected with the second connecter at the downstream condenser end and the auxiliary valve placed in the closed condition to cause fluid flowing through the third conduit to pass through the auxiliary condenser unit to undergo further heat transfer before flowing into the receiver-separator vessel.

From the above description, it may be understood that the method employed by refrigerant purification and recovery apparatus comprising the present invention includes compressing the refrigerant; passing the refrigerant through a condenser to remove heat from the refrigerant; passing the refrigerant into a containment vessel with a vent valve at its top and a drain valve at its bottom; sensing a liquid level of liquid refrigerant in a bottom portion of the vessel; sensing the pressure of gaseous refrigerant in a top portion of the vessel; allowing gas to vent from the top of the vessel only when the liquid refrigerant is below a predetermined level and the gas pressure is above a predetermined pressure, and allowing liquid to drain from the bottom of the vessel only when the liquid refrigerant is above a predetermined level and the gas pressure is above a predetermined pressure.

Additional objects, advantages and novel features of the invention shall be set forth in part in the description that follows, and in part will become apparent to those skilled in the art upon examination of the following or may be learned by the practice of the invention. The objects and the advantages of the invention may be realized and attained by means of the instrumentalities and in combinations particularly pointed out in the appended claims.

BRIEF DESCRIPTION OF THE DRAWINGS

The accompanying drawings, which are incorporated herein and form a part of the specification, illustrate refrigerant purification and recovery apparatus comprising preferred embodiments of the present invention, and together with the description, serve to explain the principles of the invention. In the drawings.

DETAILED DESCRIPTION OF THE INVENTION

Figure 1:
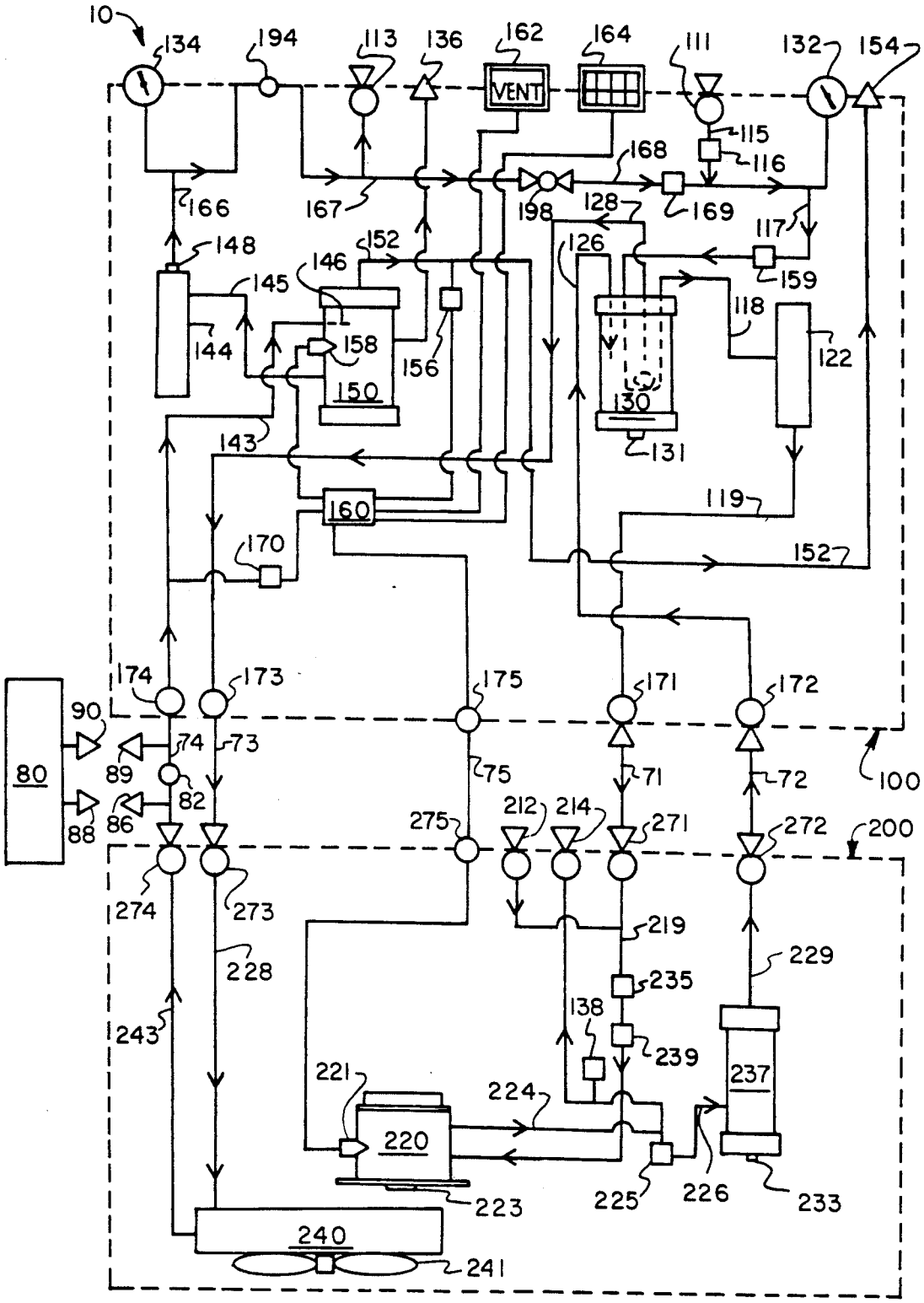
FIG. 1 is a schematic drawing of the fluid circuit of a refrigerant purification and recovery apparatus comprising a preferred embodiment of the present invention.
Figure 2:
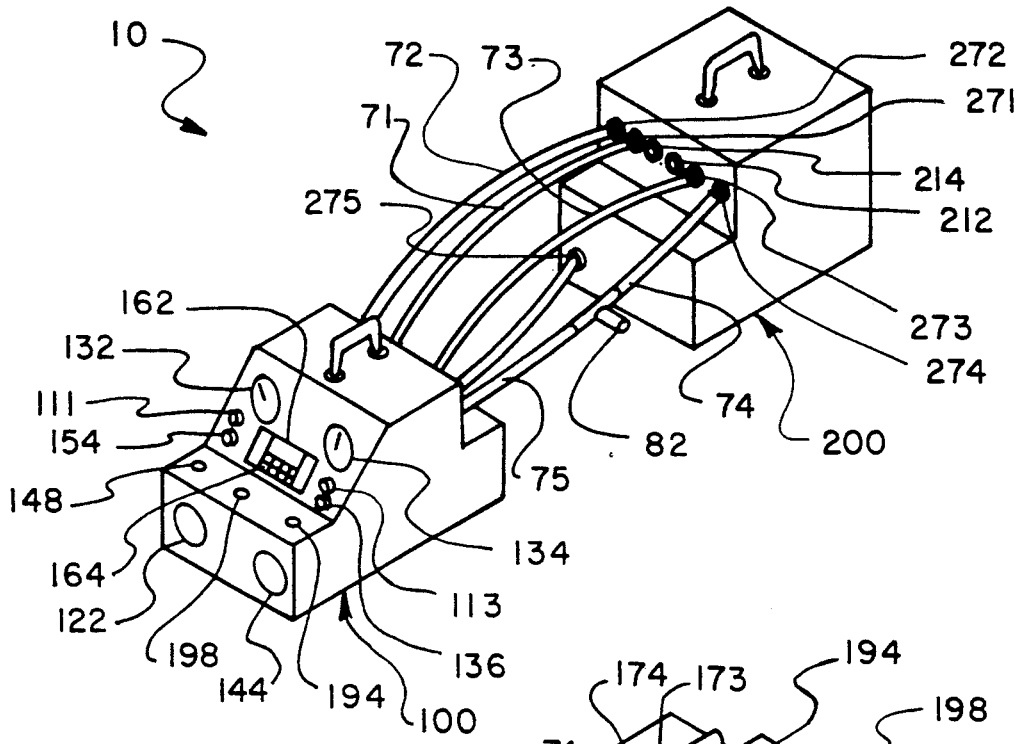
FIG. 2 is an isometric pictorial view showing the front of the cabinets of both units of the preferred embodiment refrigerant purification and recovery apparatus shown in FIG. 1.
Figure 3:
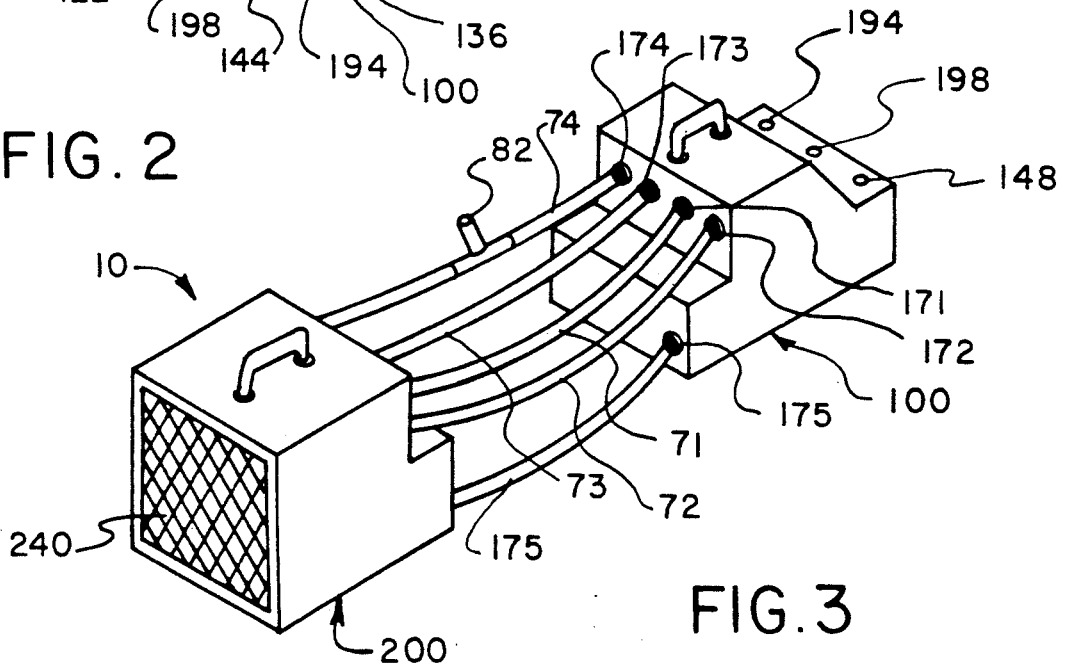
FIG. 3 is an isometric pictorial view showing the back of the cabinets of both units of the preferred embodiment refrigerant purification and recovery unit of FIGS. 1 and 2.

A schematic representation of a refrigerant purification and recovery apparatus 10 which comprises a plurality of units according to the principles of the present invention is shown in FIGS. 1, 2, and 3. In the preferred embodiment, refrigerant purification and recovery apparatus 10 is comprised of two separate light weight modules or units 100 and 200. Separating purification recovery apparatus 10 into first unit 100 and second unit 200, makes apparatus 10 easier to handle, maneuver into position, and use, therefore allowing apparatus 10 to service a wider range of refrigerant charged refrigeration units. In some instances this plurality of units allows purification and recovery apparatus 10 to service refrigerant charged refrigeration units which heretofore were virtually unserviceable, to the extent of purifying and recovering the refrigerant, because they were either too remote, such as up ladders, or situated in quarters which were too cramped.

After purification and recovery apparatus 10 is conveniently transported to within reach of a refrigerant charged refrigeration unit as separate units 100 and 200. Units 100 and 200 are then connected in fluid communication with each other by thermally insulated, flexible hose 71, 72, 73, and 74. Connections are provided for flexible hoses 71, 72, 73, and 74 in unit 100 at valves 171, 172, 173, and 174, respectively. Similarly, connections in unit 200 are provided for hoses 71, 72, 73, and 74 at valves 271, 272, 273, and 274, respectively. To facilitate ease in set-up and convenience in use, valves 171, 172, 173, 174, 271, 272, 273, and 274 are preferably pop-it valves, but may also be ball valves or externally threaded nipples with Schrader-type valves, in which case hoses 71, 72, 73, and 74 would include flanged ends with overlying internally threaded rings. Units 100 and 200 are also placed in electrical communication by way of a bus 75 which is connected to a 9 pin connection 275 in unit 200 and a 9 pin pigtail connection 175 in unit 100. Greater detail concerning the purpose and operation of these valves, flexible hoses, pin connections and the bus will be given below.

With primary reference to FIG. 1, when refrigerant purification and recovery apparatus 10 is in use, input connection valve 111 is connected to the fluid circuit of the refrigeration unit from which the refrigerant is to be removed via means of conduits, such as suction hoses, adapted for connection to connectors provided on the refrigeration unit, generally near the suction side of the refrigerant unit compressor. When the recovery-purification process is begun by opening an outlet valve on the refrigeration unit, opening input valve 111 and providing power to compressor 220 of the purification recovery apparatus 10, refrigerant is drawn from the refrigeration unit through input connection valve 111, conduit 115, check valve 116, conduit 117, and temperature expansion valve 159, into heat exchanger 130. From heat exchanger 130, the refrigerant passes through conduit 118 to vapor or suction filter 122. Suction filter 122 is a highly desiccant filter and also contains, for example, alumina and phosphate to mechanically and/or chemically remove both water and acid from the refrigerant to the extent possible while the refrigerant is still in gaseous phase. From suction filter 122 the refrigerant is drawn through conduit 119 to valve 171, through flexible hose 71, and to valve 271 in unit 200. From valve 271 the refrigerant is drawn through conduit 219, solenoid valve 235, and pressure regulator 239 to the suction side of compressor 220. Following compression, the refrigerant leaves compressor 220 at an elevated pressure, for example 250 psi, and elevated temperature, and flows through conduit 224, check valve 225 and conduit 226 to oil trap 237. As the name implies, oil trap 237 is to trap and remove excess oil from the refrigerant. From oil trap 237, refrigerant flows through conduit 229, valve 272, flexible hose 72, and valve 172. Having returned to unit 100, refrigerant returns to heat exchanger 130 by way of conduit 126. In heat exchanger 130, thermal energy is drawn from the compressed refrigerant by refrigerant in the compressor suction side refrigerant flow through conduit 117 and 118. This assures that the refrigerant drawn from the refrigerant unit is in a single phase gas flow when passing through suction filter 122 and eventually into the suction side of compressor 220.

Additional oil contaminants suspended in the recovered refrigerant may precipitate from the suction side flow as it passes through heat exchanger 130 and accumulate in the bottom portion of heat exchanger 130. Drain valve 131 is provided at the base of heat exchanger 130 to allow any accumulated oil to be periodically drawn off and discharged.

From heat exchanger 130, the high pressure refrigerant flows through conduit 128, valve 173, flexible hose 73, and returns to unit 200 by way of valve 273. From valve 273 high pressure refrigerant flows through conduit 228 to condenser 240. In condenser 240, the high temperature-pressure refrigerant is cooled by heat exchange with an external fluid, such as ambient air, and begins condensation to a liquid phase. Air cooling may be augmented by fan 241, or, in the alternative, another fluid, such as cold water, may be flushed over condenser 240 to enhance heat exchange.

The condensed refrigerant then passes through conduit 243, valve 274, and flexible hose 74, returning to unit 100 by way of valve 174. The condensed refrigerant then flows from valve 174, through conduit 143, and into receiver-separator vessel 150 at a refrigerant injection point 146. Receiver-separator 150 of refrigerant recovery-purification apparatus 10 embodying the present invention, is vertically oriented such that denser, liquid-phase refrigerant will accumulate in a lower portion of receiver-separator vessel 150 with higher gas-phase refrigerant and gaseous "noncondensible" contaminants, residing above the liquid phase refrigerant. The "noncondensible" contaminants, for example, air, helium, nitrogen, etc., are of lower molecular weight than the refrigerant, and, thus, will occupy the upper most portion of vessel 150, above the gaseous refrigerant.

Vent line conduit 152 leads from the upper most portion of receiver-separator vessel 150 to vent valve 154, which may be opened to vent gas from the upper portion of vessel 150 to the atmosphere. Pressure sensor 156 is in fluid communication with vent line conduit 152 to sense the pressure of the gasses in the upper portion of vessel 150 and line 152 and generate a signal indicative of the pressure sensed. Pressure sensor 156 may be any of the pressure sensors well known to those of the art.

Conduit 145 leads from the bottom most portion of vessel 150 to liquid filter 144. Filter 144 may be of any of the materials well known to those of the art, which mechanically and/or chemically remove water or acid from the refrigerant. There is a sightglass 148 in filter 144 which allows an operator to monitor the moisture saturation level within liquid filter 144. For example, when filter 144 has reached its moisture saturation level a blue dot may appear in sightglass 148. From liquid filter 144, liquid refrigerant flows through drain conduit 166 to liquid drain valve 113 which may be opened to allow liquid refrigerant to flow from the lower portion of vessel 150 through filter 144 and into a refrigerant unit or into a temporary storage vessel which may be attached to valve 113.

A liquid sensor 158 is located at a point on the wall of vessel 150 between the top and bottom of vessel 150, preferably below refrigerant injection point 146. Liquid sensor 158 may be a photo electric sensor or any other suitable sensor known to those skilled in the art. In the preferred embodiment, microprocessor 160 receives pressure indicative signals generated by pressure sensor 156 and liquid presence signals from liquid sensor 158 and, dependent upon the signals received, controls display device 162 to display a message or other signal to prompt the operator of refrigerant purification and recovery apparatus 10 to open valve 154 or valve 113 at appropriate times for appropriate periods. Display device 162 may be an LCD, any other available display screen, or even a panel of colored lights, as will be discussed below in the alternative embodiment. When microprocessor 160 receives a pressure indicative signal from pressure sensor 156 indicative of a pressure higher than a predetermined pressure, which may, for example, be 225 psi in the case of refrigerant $R_{12}$ and $R_{500}$ or 270 psi in the case of $R_{22}$ and $R_{502}$, and a liquid indicative signal from liquid sensor 158 indicative of a liquid present at the sensor microprocessor 160 will cause display 162 to prompt the operator to open liquid drain valve 113 to drain liquid from vessel 150. When microprocessor 160 receives a pressure indicative signal from pressure sensor 156 indicative of a pressure higher than a predetermined pressure, which may, for example, be 225 psi in the case of refrigerant $R_{12}$ and $R_{500}$ or 270 psi in the case of $R_{22}$ and $R_{502}$, and a liquid presence indicative signal from liquid sensor 156 indicative of no liquid present at the location of liquid sensor 158 on the wall of vessel 150, microprocessor 160 will cause display 162 to prompt the operator of refrigerant recovery-purification apparatus 10 to open vent valve 154 to vent "noncondensible" gasses from the upper most portion of vessel 150 to the atmosphere.

Those familiar with the art will recognize that valves 113 and 154 may be power operated valves, such as solenoid controlled valves, and microprocessor 160 may be arranged to automatically operate those valves in accordance with signals received from pressure sensor 156 and liquid sensor 158 in addition to, or instead of, causing an operator prompt to be displayed on display 162. In the preferred embodiment, the predetermined pressure at which purging of "noncondensible" gasses or drawing off of liquid refrigerant will be initiated may be set by means of an input device such as keyboard 164 so that an appropriate pressure may be selected at which to vent or drain the vessel 150 dependent upon the particular type of refrigerant which is being purified and recovered.

Refrigerant recovery-purification apparatus 10 further comprises a line temperature sensor 170 for sensing the temperature of the exterior surface of the downstream end of conduit 143 of recovery-purification apparatus 10 and generating a temperature indicative signal indicative of the temperature sensed. When microprocessor 160 receives a temperature indicative signal from line temperature sensor 170 indicative of a temperature above a predetermined temperature range over which condenser 240 will cool compressed refrigerant at a rate sufficient for adequate condensation to occur, microprocessor 160 causes display 162 to prompt the operator of refrigerant purification and recovery apparatus 10 to connect auxiliary condenser unit 80 (seen only in FIG. 1) to purification and recovery apparatus 10. The predetermined temperature, above which display 162 will prompt the operator to connect auxiliary condenser unit 80, may, be for example, 112° F.

Exemplary purification and recovery apparatus 10 may include auxiliary valve 82 located between unit 200 and unit 100 in flexible hose 74. Releasable connectors 84, 86 are located on flexible hose 74 upstream and downstream of auxiliary valve 82, respectively. Auxiliary condenser unit 80 is provided with connectors 88 and 90 at its upstream and downstream end, respectively, which are adapted to releasably engage connectors 86, 84, respectively, and provide fluid communication between the upstream and downstream ends of auxiliary condenser 80 and hose 74. Thus, with releasable connectors 86, 84 connected with upstream connector 88 and downstream connector 90 of auxiliary condenser unit 80, respectively, and valve 82 turned to a closed condition, refrigerant will be caused to flow through auxiliary condenser unit 80 for additional cooling of the high pressure refrigerant. Auxiliary condenser unit 80 may be provided with a fan (not shown) to augment heat transfer to the ambient air, or may include a water jacket or similar provision to allow cooling of the high pressure refrigerant by other available fluid heat sinks, as was described above with reference to condenser 240. Releasable connectors 84, 86 may be of any type well known to those knowledgeable of the art, for example, connectors 84, 86 may comprise externally threaded nipples with Schrader-type valves, while auxiliary connectors 90, 88 may include flanges with overlying internally threaded rings, sized to cooperate with the external threads of the nipples, and central pin elements to open the Schrader-type valves and provide fluid communication between auxiliary condenser unit 80 and hose 74 when the rings are engaged with the external threads and the flanges pulled down on releasable connectors 84, 86 by turning the rings.

During periods of high load or high ambient temperature, increased cooling of compressor 220 of refrigerant recovery and purification apparatus 10 may be accomplished by opening valve 198. When valve 198 is in an open position, liquid refrigerant under pressure will flow from the lower portion of receiver-separator vessel 150 through conduit 145, filter 144, conduit 166, interconnect conduit 167, valve 198, interconnect conduit 168 and orifice 169 to be introduced into conduit 117. Thus, with valve 198 in the open position, liquid refrigerant from receiver-separator vessel 150 will expand to gas phase and mix with and cool the suction side refrigerant flow eventually entering compressor 220. In the preferred embodiment of FIG. 1, valve 198 is a ball valve but may be any suitable valve well known to those knowledgeable of the art. The purpose of orifice 169 is to reduce the pressure of the refrigerant flow before it enters conduit 117.

Those familiar with the art will recognize that control-signal devices other than microprocessor 160 may be used to prompt the operator of purification recovery apparatus 10 or to effect automatic operation of valves 113 and 154 to purge "noncondensible" gases and drain refrigerant from vessel 150 as appropriate. For example, an analog electrical circuit, such as control circuit 400 of FIG. 4, may be used to prompt the operator by means of labeled or colored lights in place of display screen 162 shown in FIGS. 1, 2, and 3.

Figure 4:
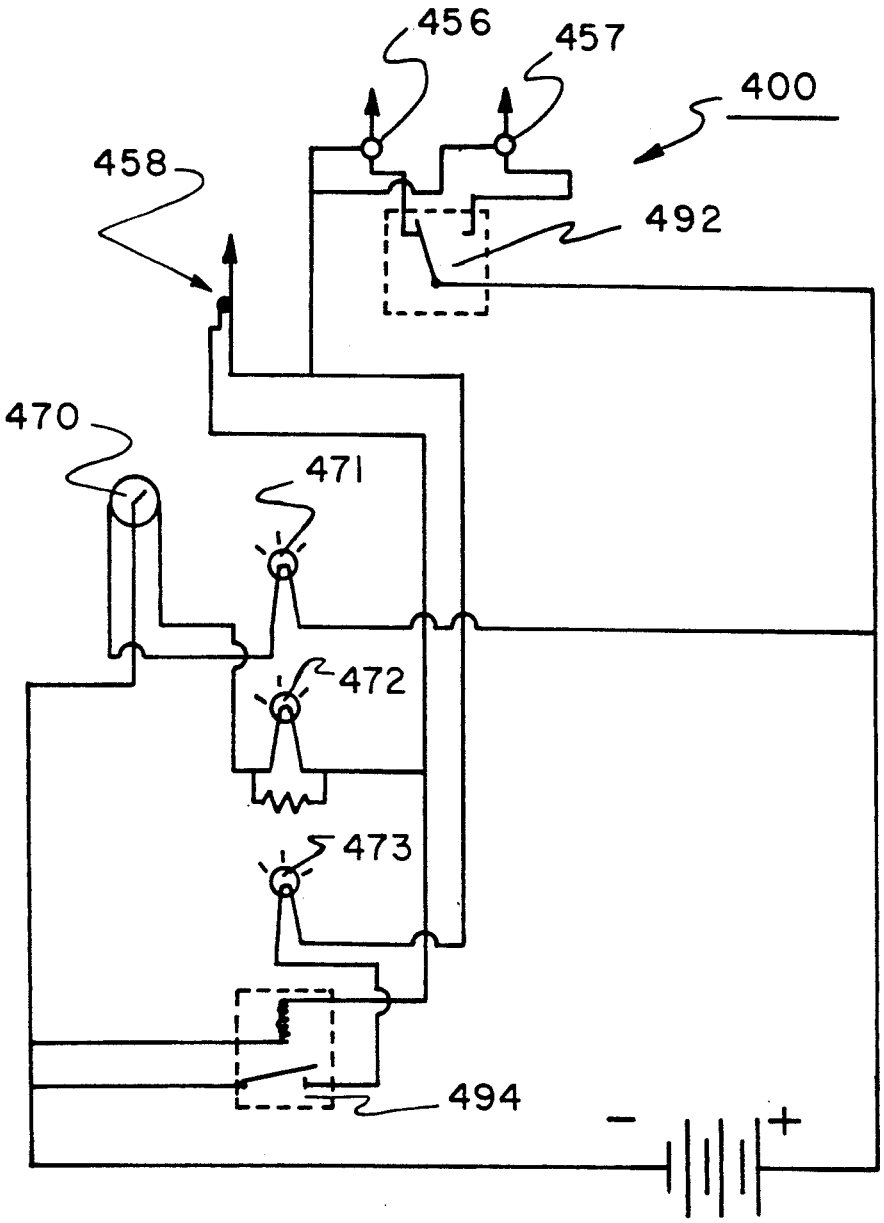
FIG. 4 is a schematic circuit drawing of an electrical control-signal circuit of a refrigerant purification and recovery apparatus comprising an alternative embodiment of the present invention.

Exemplary control-signal circuit 400 comprising an alternative embodiment of the present invention causes an appropriate one of high line temperature prompt light 471, vent prompt light 472 or drain prompt light 473 to light in response to high line temperature, as determined by line temperature sensor 470, pressures sensed in receiver-separator vessel 150, as detected by pressure sensor switch 456 or 457, and liquid level in the receiver-separator vessel 150, as determined by liquid sensor 458. In this alternative embodiment control-signal circuit 400, analog temperature sensor 470 would replace digital temperature sensor 170, seen in FIG. 1, analog pressure sensor switch 456 would replace digital pressure sensor 156, seen in FIG. 1, and analog liquid sensor 458 would replace digital liquid sensor 158, also seen in FIG. 1. At line temperatures above a predetermined temperature, temperature detector 470 will open the vent prompt light portion of control-signal circuit 400 including vent light 472 and close the portion of control-signal circuit 400 including high line temperature light 471 to energize high line temperature light 471 and prompt an operator of the refrigerant recovery and purification apparatus 10 to install auxiliary condenser 80 as described above. Two position toggle switch 492 provides selection between low threshold pressure sensor switch 456 and high threshold pressure sensor switch 457 as appropriate for the particular type of refrigerant being recovered and purified. In the illustration of FIG. 4, low threshold pressure sensor 456 is selected. When the pressure in receiver-separator vessel 150 exceeds the low threshold pressure, pressure sensor 456 will close the sensor portion of control-signal circuit 400 to energize vent prompt light 472 or drain prompt light 473. Optical liquid sensor 458 imposes a voltage drop between pressure sensor 456 and vent prompt light 472 which varies dependent upon the presence or absence of liquid as sensed by sensor 458. When liquid sensor 458 senses liquid, a large voltage drop is imposed and, when the pressure sensor portion of control-signal circuit 400 is closed, drain prompt light 473 will be energized, while vent prompt light 472 will be illuminated. When liquid sensor 458 does not sense the presence of liquid, little or no voltage drop is imposed upon the vent prompt light portion of control-signal circuit 400 and, when the pressure sensor portion of control-signal circuit 400 is closed, vent prompt light 473 will be energized together with relay 494. Thus, relay 494 will open the drain prompt light circuit including drain prompt light 473, deenergizing drain prompt light 473, and only vent prompt light 472 will be energized and illuminated. In this manner, control-signal circuit 400 prompts an operator of the apparatus to drain liquid refrigerant from receiver-separator vessel 150 only when the pressure within the vessel exceeds a predetermined threshold pressure and the liquid in the vessel is above a predetermined level, and prompts an operator of the apparatus to vent the gasses from the receiver-separator vessel only when the pressure within the vessel is above a predetermined pressure and the liquid level in the vessel is below a predetermined liquid level.

As may be seen from FIGS. 1, 2 and 3, refrigerant purification and recovery apparatus 10 also includes suction gauge 132 and high pressure gauge 134 to allow an operator of refrigerant purification recovery apparatus 10 to monitor its operation. Further, high pressure release valve 136 is provided on the upper portion of vessel 150 to bleed gas from the upper portion of vessel 150 should pressure in the vessel exceed a predetermined safe operating pressure. Cut out pressure sensor 138 is provided to sense the pressure of the high pressure refrigerant and should the pressure exceed a predetermined safe operating pressure, cut off power to compressor 220. Sight glass 194 is provided on interconnect conduit 166 in fluid communication with the lower end portion of receiver-separator vessel 150 by way of filter 144 and includes a moisture monitor, which may be of any of the many types known to those familiar with the art. Sight glass 194 may, for example, change color to indicate moisture is present in the recovered refrigerant. Should excess moisture be present, valve 198 may be opened to allow recovered refrigerant to recirculate via drain line 166 and interconnect lines 167, 168 to again pass through suction filter 122, including a desiccant, until moisture is sufficiently removed from the recovered refrigerant.

Compressor 120 may be a hermetically sealed compressor such as are commonly used in refrigeration units. Such compressors are intended to recirculate a known quantity of refrigerant in a closed fluid loop to which an appropriate amount of lubricant is introduced to lubricate the compressor. Compressor 220, however, is subject to contaminated refrigerant charges whose lubricant content is unknown and uncontrollable. Thus, oil sensor 221 is provided in the housing of compressor 220 and generates an electrical signal indicative of the amount of oil in the housing of compressor 220 which is received by microprocessor 160 by way of connector 275, bus 75, and connector 175. When microprocessor 160 receives an oil indicative signal indicative of a low oil level in the housing of compressor 220, microprocessor 160 causes display 162 to display a prompt message or other signal to prompt the operator of refrigerant purification and recovery apparatus 10 to add oil to compressor 220. Upon such a prompt, the operator may introduce oil to the housing of compressor 220 through suction side valve 212. In the event there is too much oil contained within the refrigerant drain valves 223 and 233 are provided in the housing of compressor 220 and oil trap 237, respectively, to allow this excess charge of oil to be removed.

As indicated above, refrigerant purified and removed by purification and recovery apparatus 10 may be drained from valve 113 into a temporary storage container or, connector-valve 113 may be directly connected to the high pressure side of the fluid circuit of the refrigeration unit to directly reintroduce the purified refrigerant into the fluid circuit of the refrigeration unit.

Figure 5:
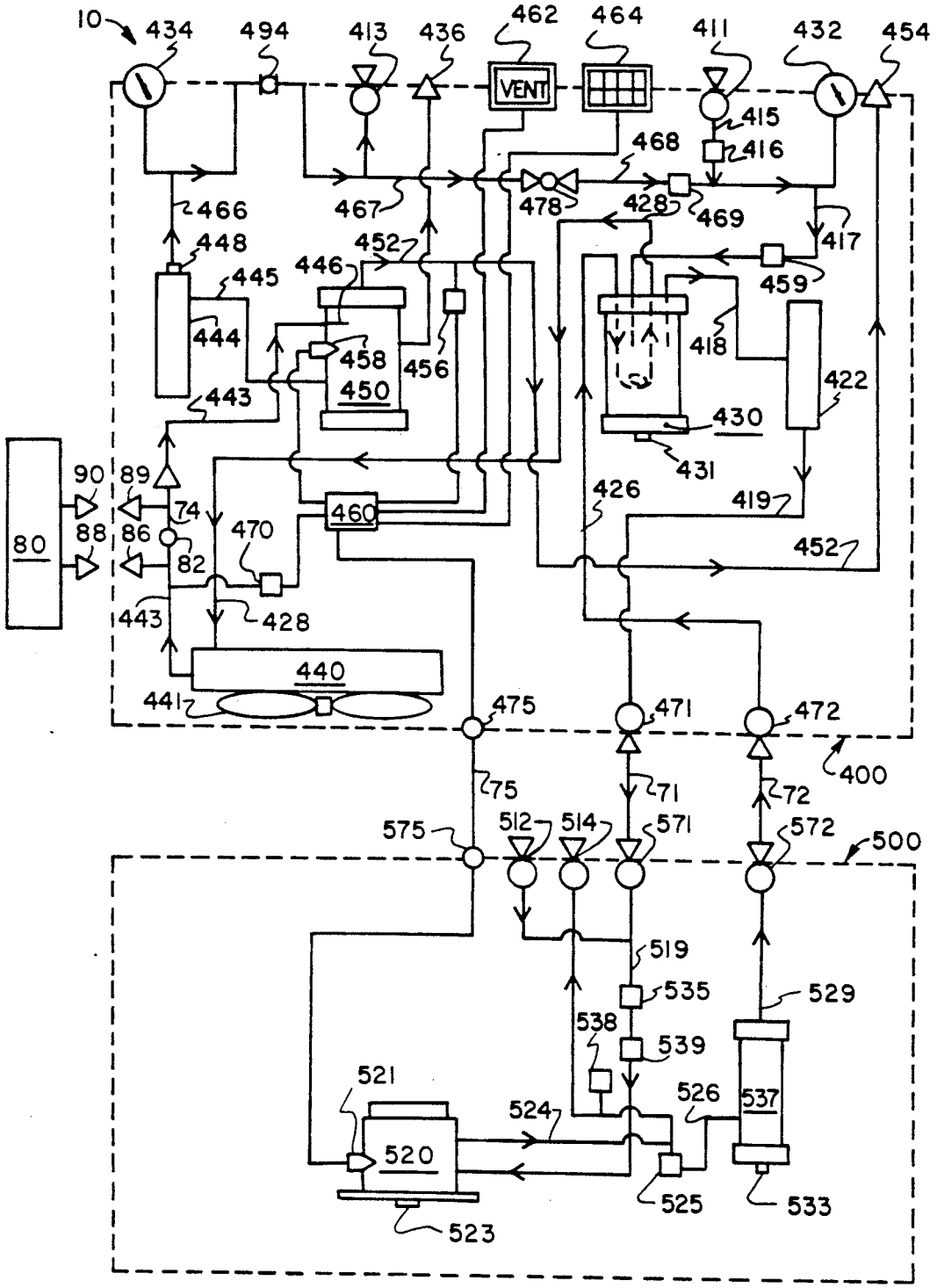
FIG. 5 is a schematic drawing of the fluid circuit of a refrigerant purification and recovery apparatus comprising an alternative embodiment of the present invention.

As can be seen from the above description, in apparatus 10 comprising the preferred embodiment, preferred unit 100 represents the purification portion of refrigerant purification and recovery apparatus 10, and unit 200 represents the recovery portion. Because of this separation of functionality, those familiar with the art will recognize that, unit 200 may be used separately as a recovery unit. In this mode, valve 212 is connected to the fluid circuit of a refrigeration to be serviced, valve 272 is connected to valve 273 by a flexible hose, and valve 274 is connected to a temporary storage container. Also, connector-valve 212 may be connected to the fluid circuit of the refrigeration unit on the suction side of the compressor of the refrigerant unit and connector-valve 214 connected to the fluid circuit of the refrigeration unit on the high pressure side of the refrigeration unit and valves 212 and 214 opened, while valves 111, 113 and 154 are closed, to allow compressor 20 of recovery and purification apparatus 10 to be utilized in place of a disabled compressor of a refrigeration unit on a temporary basis. A refrigerant recovery and purification apparatus comprising an alternative embodiment of the present invention shown in FIG. 5. In that alternative embodiment, compressor 520 and condenser 440 are contained in separate units, 500 and 400, respectively, of refrigerant recovery and purification apparatus 310.

While exemplary refrigeration purification and recovery apparatus comprising a preferred embodiment of the present invention has been shown, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention as defined by the claims which follow.

The embodiments of the invention in which an exclusive property or privilege is claimed are defined as follows:

1. A refrigerant purification and recovery apparatus for removing refrigerant from a refrigeration unit, purifying the refrigerant, and directly reintroducing the refrigerant to the refrigeration unit or introducing the refrigerant into a storage container, the apparatus having an apparatus mass, and comprising:

a plurality of units, each of said units having a mass less than the apparatus mass; and, facilitated connection and release means for providing expedited, releasable, functional connection of said units for refrigerant processing and subsequent expediated release of each of said units from each other unit to allow each unit to be transported individually.

2. A refrigerant recovery apparatus as in claim 1 in which the recovery apparatus has an apparatus volume and each of said units has a volume less than the apparatus volume.

3. A refrigerant recovery apparatus as in claim 1 in which the recovery apparatus has a compressor and a condenser and one of said units comprises the compressor and another of said units comprises the condenser.

4. A refrigerant recovery apparatus as in claim 1 in which the recovery apparatus has a compressor and a condenser and one of said units comprises both the compressor and the condenser.

5. A refrigerant purification and recovery apparatus as in claim 1 further comprising:

compressor means having a suction side and a high pressure side for compressing refrigerant gas;

first conduit means for conducting refrigerant from a fluid circuit of the refrigeration unit to the compressor, said first conduit means having an upstream end and a downstream end, said first conduit upstream end including coupling means for coupling said first conduit in fluid communication with the refrigeration unit fluid circuit, said first conduit downstream end connected to said suction side of said compressor;

condenser means for facilitating heat exchange from refrigerant within said condenser means to fluid external of aid condenser means;

second conduit means for conducting fluid from said high pressure side of said compressor to said condenser, said second conduit means having an upstream end and a downstream end, said second conduit means upstream end attached to said high pressure side of said compressor and said second conduit means downstream end attached to said condenser;

receiver-separator vessel means for receiving and containing refrigerant at a pressure higher than an ambient pressure, said receiver-separator vessel means having an upper end portion and a lower end portion;

third conduit means for conducting refrigerant from said condenser to said receiver-separator means, said third conduit means having an upstream and a downstream end, said third conduit means upstream end connected to said condenser and said third conduit downstream end connected to said receiver-separator means;

pressure detection means for generating pressure indicative signals representative of a pressure within said upper end potion of said receiver-separator means;

liquid detection means for detecting the presence of a liquid in said receiver-separator means at a position between said upper end portion and said lower end portion and generating a liquid-presence indicative signal indicative of the presence or absence of liquid;

vent means for venting gas from said upper end portion of said receiver-separator means;

drain means for draining liquid from said lower end portion of said receiver-separator means;

control-signal means for receiving said pressure indicative signals and said liquid-presence indicative signals and generating a drain signal only when said pressure indicative signal is indicative of a pressure greater than a predetermined pressure and said liquid presence indicative signal is indicative of a liquid present, and generating a vent signal only when said pressure indicative signal is indicative of a pressure greater than a predetermined pressure and said liquid presence indicative signal is indicative of no liquid present.

6. The refrigerant purification and recovery apparatus of claim 1, wherein said compressor means, condenser means, and receiver-separator vessel means are distributed among said plurality of units.

7. The refrigerant purification and recovery apparatus of claim 5, wherein said plurality of units includes a first unit and a second unit, said first unit comprising said receiver-separator vessel, and said second unit comprising said compressor and said condenser.

8. The refrigerant purification and recovery apparatus of claim 7, wherein said first unit comprises said upstream end of said first conduit means and said first conduit means includes a section running between and releasably connecting said first unit and said second unit.

9. The refrigerant purification and recovery apparatus of claim 7, wherein said second conduit means includes a section running between the releasably connecting said first unit and said second unit.

10. The refrigerant purification and recovery apparatus of claim 7, wherein said third conduit means includes a section running between and releasably connecting said first unit and said second unit.

11. A refrigerant purification recovery apparatus as in claim 5, further comprising heat exchanger means for exchanging heat between fluid conducted by said first conduit means and another fluid.

12. A refrigerant purification recovery apparatus as in claim 5 further comprising heat exchanger means for exchanging heat between fluid conducted by said second conduit means and another fluid.

13. A refrigerant purification and recovery apparatus as in claim 5 in which said control-signal means includes a microprocessor.

14. A refrigerant purification and recovery apparatus as in claim 5 further comprising:

vent control means for causing said vent means to vent gas from said receiver-separator vessel means when said vent signal is generated; and drain control means for causing said drain means to drain liquid from said receiver-separator vessel means when said drain signal is generated.

15. A refrigerant purification and recovery apparatus as in claim 14, in which said vent control means comprises a solenoid and said drain control means comprises a solenoid.

16. A refrigerant purification and recovery apparatus as in claim 1, further comprising:

compressor means for compressing refrigerant, said compressor means hermetically sealed; and, lubricant sensing means for sensing an amount of lubricant in a housing of said hermetically sealed compressor means and generating a signal when the amount is greater than a predetermined amount.

17. A refrigerant purification and recovery apparatus as in claim 16 further comprising lubricant draining means for draining a lubricant from a housing of said hermetically sealed compressor means.

18. A refrigerant purification and recovery apparatus as in claim 5 in which said first conduit means includes filter means for filtering refrigerant flowing within said first conduit means.

19. A refrigerant purification and recovery apparatus as in claim 5 in which said third conduit means includes filter means for filtering refrigerant flowing within said third conduit means.

20. A refrigerant purification and recovery apparatus as in claim 5, wherein said third conduit filter means includes a moisture level indicator means.

21. A refrigerant purification and recovery apparatus as in claim 5 in which said first conduit means includes filter means for filtering refrigerant flowing within said first conduit means and said second conduit means includes filter means for filtering refrigerant flowing within said second conduit means.

22. A refrigerant purification and recovery apparatus as in claim 5 in which said compressor means includes an oil drain valve.

23. A refrigerant purification and recovery apparatus for removing refrigerant from a refrigeration unit and having an apparatus mass comprising:

a plurality of units, each of said units having a mass less than the apparatus mass;

facilitated connection and release means for providing expediated, releasible, functional connection of said units for refrigerant processing and subsequent expedited release of each of said units from each other unit to allow each unit to be transported individually compressor means for compressing refrigerant gas;

first conduit means for conducting refrigerant from the refrigeration unit to the compressor, said first conduit means having an upstream end and a downstream end, said first conduit upstream end including coupling means for coupling said first conduit in fluid communication with a refrigeration unit fluid circuit, said first conduit downstream end connected to a suction side of said compressor;

condenser means for facilitating heat exchange from refrigerant within said condenser means to fluid external of said condenser means;

second conduit means for conducting fluid from a high pressure side of said compressor to said condenser, said second conduit means having an upstream end and a downstream end, said second conduit means upstream end attached to said compressor and said second conduit means downstream end attached to said condenser;

receiver vessel means for receiving and containing refrigerant at a pressure higher than an ambient pressure;

third conduit means for conducting refrigerant from said condenser to said receiver vessel means, said third conduit means having an upstream end and a downstream end, said third conduit means upstream end connected to said condenser and said third conduit downstream end connected to said receiver vessel means;

auxiliary condenser means for facilitating heat transfer between refrigerant within said auxiliary condenser, means and a fluid external of said auxiliary condenser means; and, said compressor means, said condenser means, said receiver vessel means and said auxiliary condenser means are distributed among said plurality of units.

24. The refrigerant purification and recovery apparatus of claim 23, wherein the number of units is three, said receiver-separator vessel is included in a first unit, said compressor and said condenser are included in a second unit, and said auxiliary condenser means is included in a third unit.

25. The refrigerant purification and recover apparatus of claim 24, wherein said upstream end of said first conduit is contained in said first unit and said first conduit means includes a section running between and releasably connecting said two units.

26. The refrigerant purification and recovery apparatus of claim 24, wherein said second conduit means includes a section running between and releasably connecting said two units.

27. The refrigerant purification and recovery apparatus of claim 23, wherein said third conduit means includes a section running between and releasably connecting two of said units.

28. A refrigerant purification and recovery apparatus as in claim 1 further comprising:

a compressor; and, lubricant sensing means for sensing an amount of lubricant in a housing of said compressor and generating a signal when the amount is greater than a predetermined amount.

29. A refrigerant purification and recovery apparatus as in claim 28 further comprising:

lubricant draining means for draining a lubricant from a housing of said compressor.

30. The refrigerant purification and recovery apparatus of claim 29, the improvement further comprising:

said compressor means is hermetically sealed.

31. In a refrigerant purification and recovery apparatus for recovering refrigerant from a refrigeration system including a refrigeration compressor, the recovery apparatus including a recovery compressor for compressing refrigerant, the improvement comprising:

first conduit means for conducting refrigerant from a fluid circuit of the refrigeration unit to the recovery compressor, said first conduit means having an upstream end and a downstream end, said first conduit upstream end including coupling means for coupling said first conduit in fluid communication with the refrigeration unit fluid circuit on a suction side of the refrigeration compressor, said first conduit downstream end connected to a suction side of the recovery compressor;

second conduit means for conducting fluid from a high pressure side of the recovery compressor to a condenser, said second conduit means having an upstream end attached to a high pressure side of the recovery compressor, valve means for blocking flow from said second conduit to said condenser and coupling means for coupling said second conduit in fluid communication with the refrigeration unit fluid circuit in a high pressure side of the refrigeration compressor, such that, the recovery compressor can be utilized in place of the refrigeration compressor when the refrigeration compressor is disabled.

32. A refrigerant recovery apparatus as in claim 1 in which the recovery apparatus has a compressor, a condenser and a refrigerant purification means for purifying refrigerant and one of said units comprises the compressor and another of said units comprises said purification means.

33. A refrigerant recovery apparatus as in claim 1 in which the recovery apparatus has a compressor, a condenser and a refrigerant purification means for purifying refrigerant and one of said units comprises the condenser and another of said units comprises said purification means.

34. A refrigerant recovery apparatus as in claim 4 further comprising a purification means for purifying refrigerant, another of said units comprising said purification means.

35. A refrigerant recovery apparatus as in claim 1 in which a first of said units comprises purification means for purifying refrigerant.

36. A refrigerant recovery apparatus as in claim 35, said first unit comprising neither a compressor nor a condenser.

37. A refrigerant recovery apparatus as in claim 1, in which said facilitated connection and release means comprises a flexible hose having a fluid conduit coupler at each of a first and second end and a first and second of said units include fluid conduit couplers adapted to couple with said first and second hose end couplers, respectively.

38. A refrigerant recovery apparatus as in claim 37, in which one of said fluid conduit couplers comprises a Schrader valve.

39. A refrigerant recovery apparatus as in claim 38, in which one of said fluid conduit couplers comprises a nipple with external threads.

40. A refrigerant recovery apparatus as in claim 37, in which said facilitated connection and release means further comprises an electrically conducting cable having an electrical coupler at each of a first and second end and a first and second of said units include electrical couplers adapted to couple with said first and second cable end couplers, respectively.

* * * * *